US007021733B2

(12) United States Patent
Darling

(10) Patent No.: US 7,021,733 B2
(45) Date of Patent: Apr. 4, 2006

(54) INK JET APPARATUS

(75) Inventor: Douglas D. Darling, Portland, OR (US)

(73) Assignee: Xerox Corporation, Stamford, CT (US)

( * ) Notice: Subject to any disclaimer, the term of this patent is extended or adjusted under 35 U.S.C. 154(b) by 247 days.

(21) Appl. No.: 10/702,246

(22) Filed: Nov. 5, 2003

(65) Prior Publication Data

US 2005/0093903 A1 May 5, 2005

(51) Int. Cl.
*B41J 29/38* (2006.01)

(52) U.S. Cl. ..... 347/11

(58) Field of Classification Search ..... 347/10, 347/11

See application file for complete search history.

(56) References Cited

U.S. PATENT DOCUMENTS 5,689,291 A * 11/1997 Tence et al. ..... 347/10
5,736,993 A 4/1998 Regimbal et al. ..... 347/11
6,099,103 A * 8/2000 Takahashi ..... 347/11
6,217,141 B1 4/2001 Nakamura et al. ..... 347/10
6,217,159 B1 4/2001 Morikoshi et al. ..... 347/71
6,305,773 B1 10/2001 Burr et al. ..... 347/11
6,312,080 B1 11/2001 De Roos et al. ..... 347/14
6,419,336 B1 * 7/2002 Takahashi ..... 347/10
6,428,134 B1 * 8/2002 Clark et al. ..... 347/10
6,598,950 B1 7/2003 Hosono et al. ..... 347/11
2001/0022596 A1 9/2001 Korol ..... 347/10
2002/0024546 A1 * 2/2002 Chang ..... 347/9
2002/0122085 A1 * 9/2002 Chaug ..... 347/11
2002/0171704 A1 * 11/2002 Yonekubo et al. ..... 347/27

* cited by examiner

*Primary Examiner*—K. Feggins
*Assistant Examiner*—Rene Garcia, Jr.
(74) *Attorney, Agent, or Firm*—Manuel Quiogue

(57) ABSTRACT

A drop emitting device that includes a drop generator and a drive signal waveform that includes in sequence a pulse of a first polarity, a first pulse of a second polarity, a delay interval, and a second pulse of the second polarity.

50 Claims, 5 Drawing Sheets

INK JET APPARATUS

BACKGROUND OF THE DISCLOSURE

The subject disclosure is generally directed to drop generating apparatus.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet drop generator structure employs an electromechanical transducer to displace ink from an ink chamber into a drop forming outlet passage, and it can be difficult to control drop velocity and/or drop mass.

DETAILED DESCRIPTION OF THE DISCLOSURE

Figure 1:
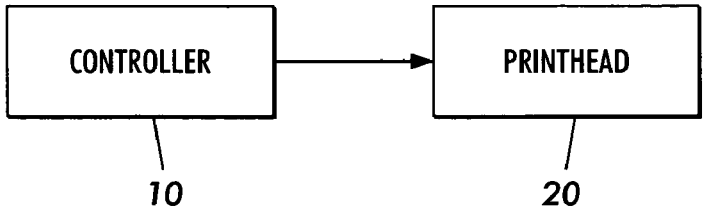
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
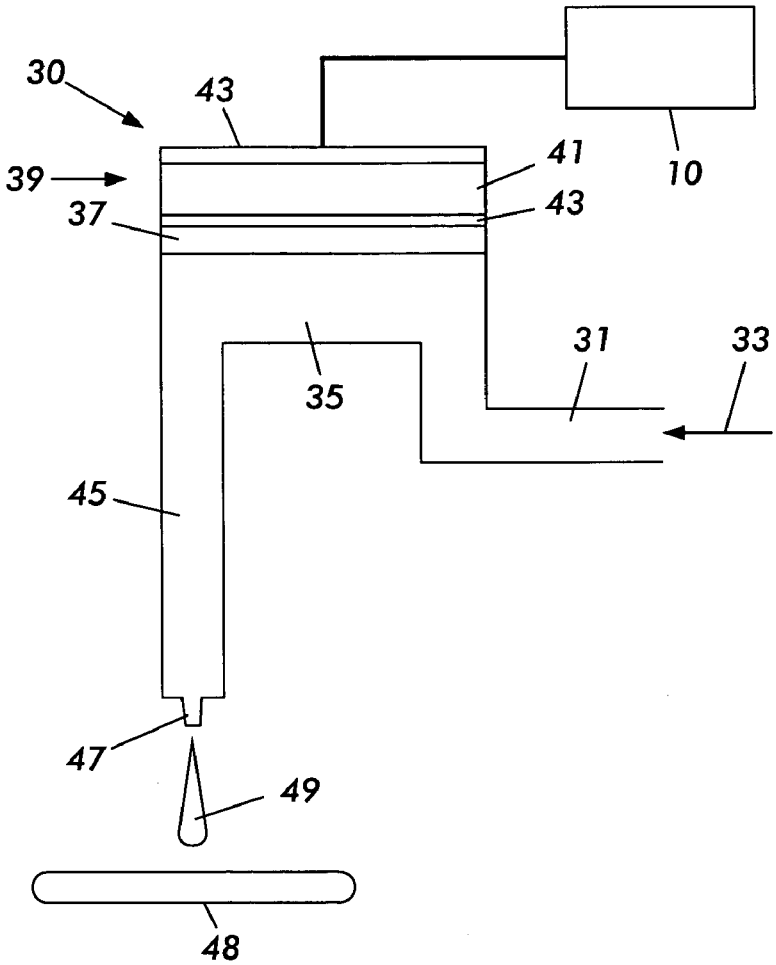
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber

35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
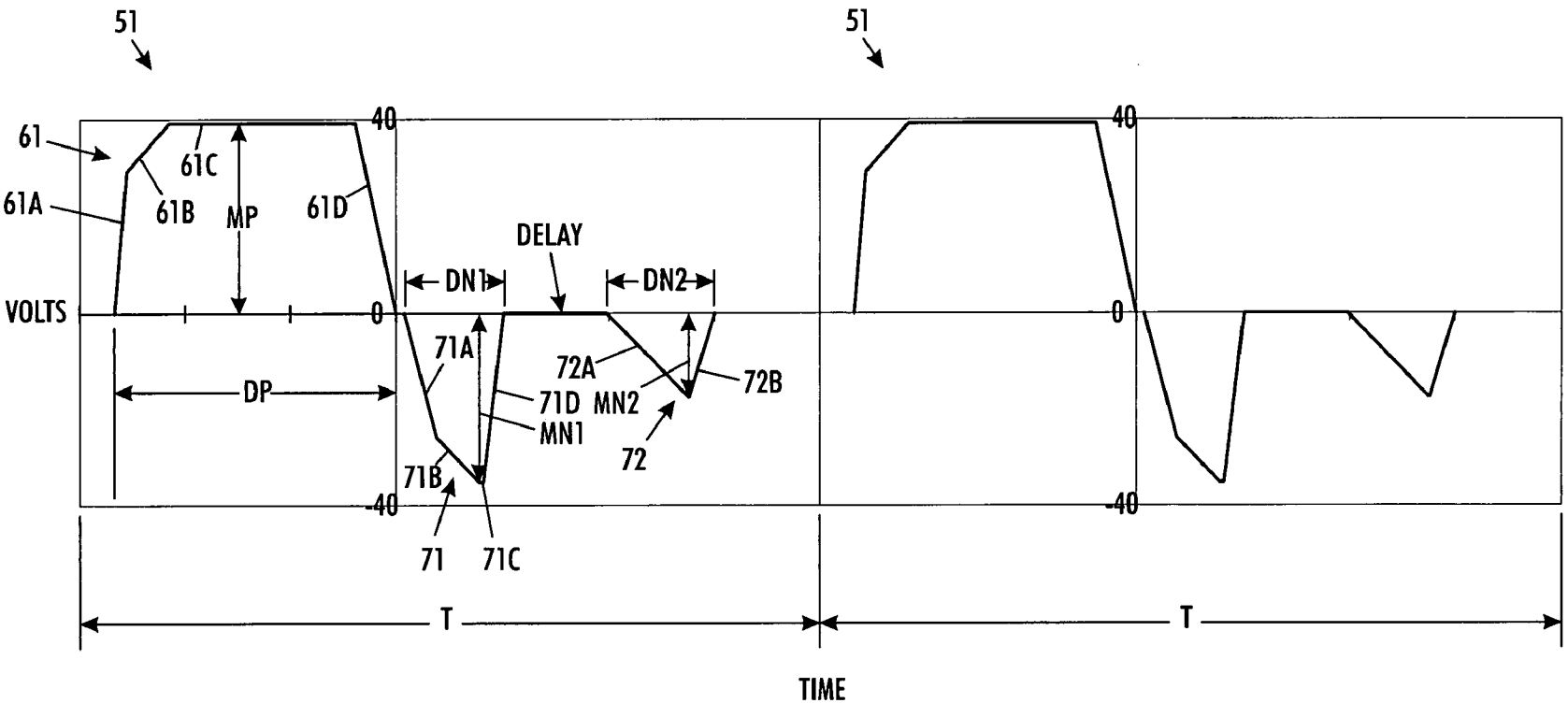
FIG. 3 is a schematic depiction of an embodiment of a drive signal that can be employed to drive the drop generator of FIG. 2.
Figure 4:
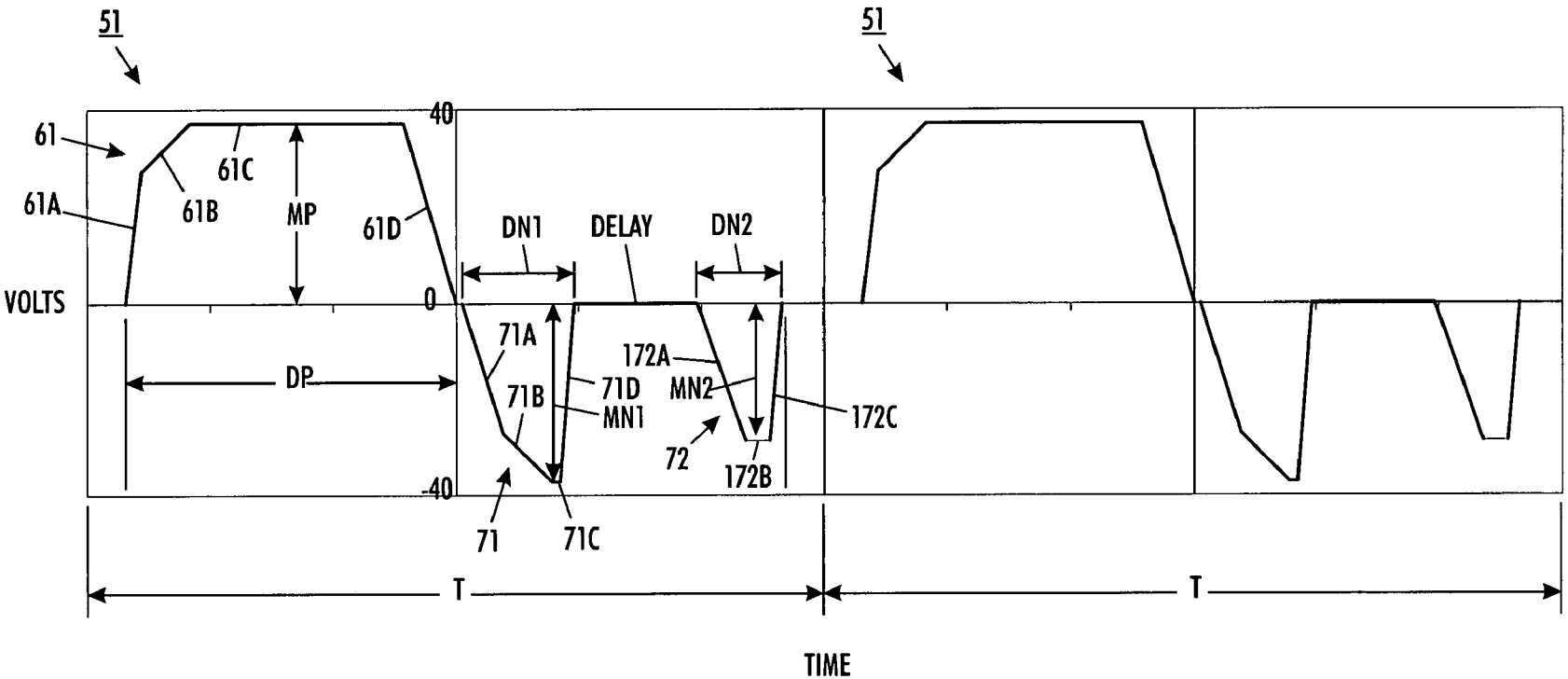
FIG. 4 is a schematic depiction of another embodiment of a drive signal that can be employed to drive the drop generator of FIG. 2.

FIGS. 3 and 4 are schematic diagrams of embodiments of a drive drop firing signal or waveform 51 that is provided to the printhead during a firing interval T to cause an ink drop to be emitted. The time varying drop firing waveform 51 is shaped or configured to actuate the electromechanical transducer such that the drop generator emits an ink drop. The duration of the waveform 51 can be less than the firing interval T. By way of illustrative example, the firing interval T can be in the range of about 100 microseconds to about 25 microseconds, such that the drop generator can be operated at a drop firing frequency in the range of about 10 KHz to about 40 KHz for the example wherein the firing interval T is substantially equal to the reciprocal of the drop firing frequency. The total duration of the waveform 51 can be in the range of about 20 microseconds to about 30 microseconds, for example.

By way of illustrative example, the drop firing waveform 51 can be a bi-polar voltage signal having in sequence a positive pulse component 61, a first negative pulse component 71, a DELAY, and a second negative pulse 72 component. The pulses are negative or positive relative to a reference such as zero volts. Each pulse is characterized by a pulse duration DP, DN1, DN2 which for convenience is measured between the pulse transition times (i.e., the transition from the reference and the transition to the reference). Each pulse is also characterized by a peak pulse magnitude MP, MN1, and MN2 which herein is a positive number.

The positive pulse 61 can have a duration DP in the range of about 10 microseconds to about 16 microseconds. The first negative pulse 71 can have a duration DN1 in the range of about 3 microseconds to about 7 microseconds. The second negative pulse 72 can have a duration DN2 in the range of about 2 microseconds to about 8 microseconds. In this manner, the positive pulse 61 can have a duration that is greater than the duration DN1 of the first negative pulse 71 and greater than the duration DN2 of the second negative pulse 72. The duration DN2 of the second negative pulse 72 can be less than or greater than the duration DN1 of the first negative pulse 71. The durations DN1, DN2 of the first and second negative pulses 71, 72 can be similar.

The positive pulse 61 can have a peak magnitude MP in the range of about 33 volts to about 47 volts. For example, the peak magnitude MP of the positive pulse 61 can be about 39 volts or less. The positive pulse 61 can include for example four segments: a first positive going segment 61A, a second positive going segment 61B, a substantially constant level segment 61C, and a negative going segment 61D. The first positive going segment 61A is steeper than the second positive going segment 61B.

The first negative pulse 71 can have a peak magnitude MN1 in the range of about 30 volts to about 47 volts. For example, the peak magnitude MN1 of the first negative pulse 71 can be about 35 volts or less. The first negative pulse 71 can have a peak magnitude MN1 that is less than the peak magnitude MP of the positive pulse 61. The first negative pulse 71 can include for example four segments: a first negative going segment 71A, a second negative going segment 71B, a substantially constant level segment 71C, and a positive going segment 71D. The first negative going segment 71A is steeper than the second negative going segment 71A. The substantially constant level segment 71C can be shorter than the substantially constant level segment 61C of the positive pulse 61.

The second negative pulse 72 can have a peak magnitude MN2 that is in the range of about 15 volts to about 47 volts. For example, the peak magnitude MN2 of the second negative pulse 72 can be about 22 volts or less. The second negative pulse 72 can have a peak magnitude MN2 that is less than the peak magnitude MP of the positive pulse 61 and is less than the peak magnitude MN1 of the first negative pulse 61. The second negative pulse 72 can be triangular (FIG. 3) or trapezoidal (FIG. 4), for example. In a triangular embodiment, the second negative pulse 72 includes a negative going segment 72A and a positive going segment 72B. In a trapezoidal embodiment, the second negative pulse 72 includes a first negative going segment 172A, a substantially constant level segment 172B, and a positive going segment 172C.

In operation, the positive pulse 61 and the first negative pulse 71 cause a drop to be emitted by varying the volume of the pressure chamber 35 (FIG. 2). The second negative pulse 72 occurs after a drop is emitted and can function to reset the drop generator so that subsequent drops are have substantially the same mass and velocity as the drop just emitted. The second negative pulse 72 is of the same polarity as the preceding first negative pulse 71, which can tend to pull the meniscus at the nozzle 47 inwardly to help prevent the meniscus from breaking. If the meniscus breaks and ink oozes out of the nozzle, the drop generator can fail to emit drops on subsequent firings.

The DELAY between the first negative pulse 71 and the second negative pulse 72 can be in the range of about 2 microseconds to about 7 microseconds.

The shape of the second negative pulse 72 can be selected such that (1) the correct amount of energy will be applied by the second negative pulse to cancel the residual energy that remains in the drop generator after a drop is emitted, (2) the second negative pulse will not itself fire a drop, and (3) the drop generator will not ingest an air bubble through the nozzle. By way of illustrative examples, the second negative pulse 72 can be generally triangular (FIG. 3) or generally trapezoidal (FIG. 4). Other shapes can be employed.

Figure 5:
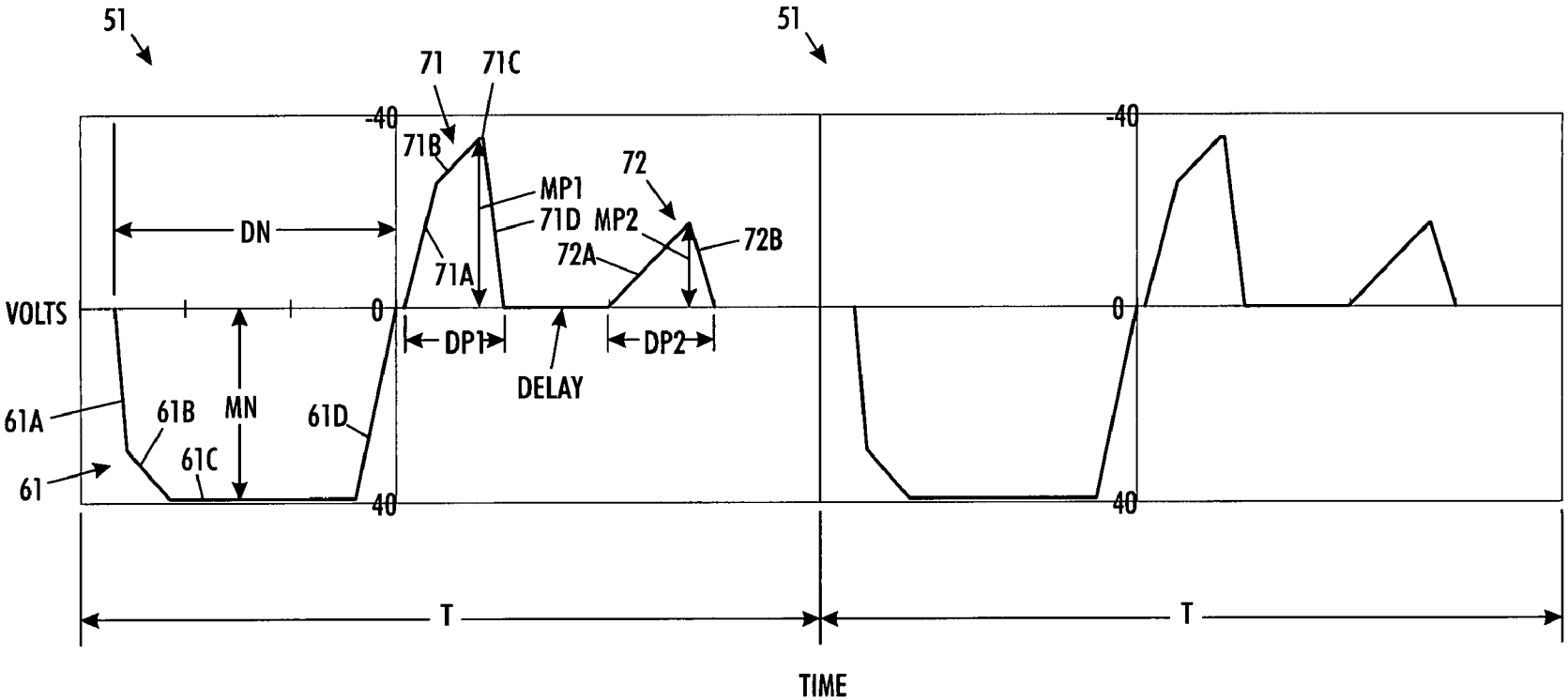
FIG. 5 is a schematic depiction of a further embodiment of a drive signal that can be employed to drive the drop generator of FIG. 2.
Figure 6:
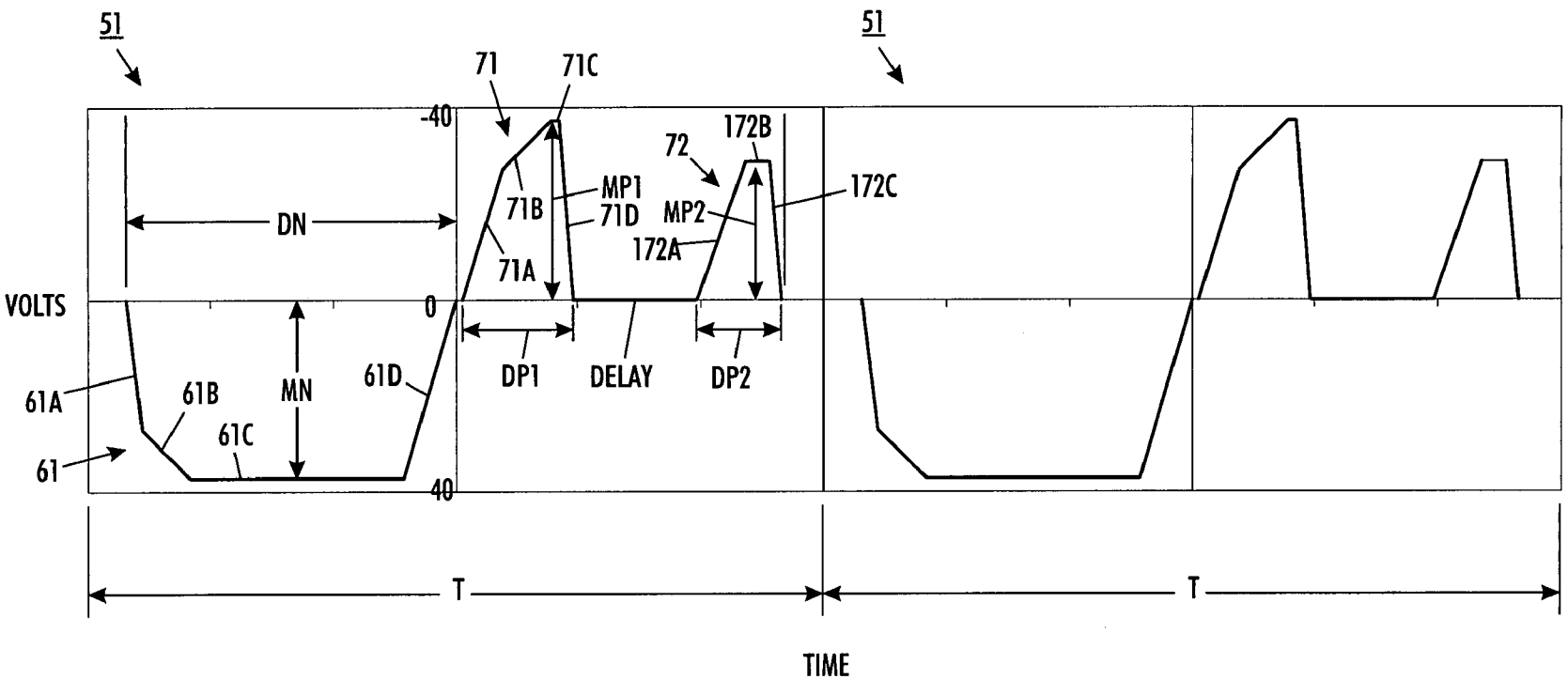
FIG. 6 is a schematic depiction of another embodiment of a drive signal that can be employed to drive the drop generator of FIG. 2.

It is more generally contemplated that the waveform 51 comprises, in sequence, a first pulse having a first polarity, a second pulse having a second polarity, a delay, and a third pulse having the second polarity. FIGS. 5 and 6 are schematic diagrams of embodiments of a drive drop firing signal or waveform 51 that are of an opposite polarity from the waveforms of FIGS. 3 and 4. The waveforms of FIGS. 5 and 6 comprise a negative going pulse 61, a first positive going pulse 71, a DELAY, and a second positive going pulse 72. The durations DN, DP1, DP2 and magnitudes MN, MP1, MP2 of the pulses of the waveforms of FIGS. 5 and 6 can be substantially the same as the durations DP, DN1, DN2 and magnitudes MP, MN1, MN2 of corresponding pulses in the waveforms of FIGS. 3 and 4.

In the waveforms of FIGS. 5 and 6, the negative going pulse 61 can include for example four segments: a first negative going segment 61A, a second negative going segment 61B, a substantially constant level segment 61C, and a positive going segment 61D. The first negative going segment 61A is steeper than the second negative going segment 61B. The first positive pulse 71 can include for example four segments: a first positive going segment 71A, a second positive going segment 71B, a substantially constant level segment 71C, and a negative going segment 71D. The first positive going segment 71A is steeper than the second positive going segment 71A. The substantially constant level segment 71C can be shorter than the substantially constant level segment 61C of the negative pulse 61. The second positive pulse 72 can be triangular (FIG. 5) or trapezoidal (FIG. 6), for example. In a triangular embodiment, the second positive pulse 72 includes a positive going segment 72A and a negative going segment 72B. In a trapezoidal embodiment, the second positive pulse 72 includes a first positive going segment 172A, a substantially constant level segment 172B, and a negative going segment 172C.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop emitting device comprising:

a drop generator;

a drop firing waveform applied to the drop generator during a drop firing interval;

the drop firing waveform including in sequence a pulse of a first polarity, a first pulse of a second polarity, a delay interval, and a second pulse of the second polarity, wherein the second polarity is different from the first polarty.

2. The drop emitting device of claim 1 wherein the drop generator comprises a piezo transducer.

3. The drop emitting device of claim 1 wherein the pulse of the first polarity and the first pulse of the second polarity are configured to cause a drop to be emitted.

4. The drop emitting device of claim 1 wherein:

the pulse of the first polarity and the first pulse of the second polarity are configured to cause a drop to be emitted; and the second pulse of the second polarity is configured to dissipate residual energy remaining in the drop generator after a drop is emitted.

5. The drop emitting device of claim 1 wherein:

the pulse of the first polarity and the first pulse of the second polarity are configured to cause a drop to be emitted; and the second pulse of the second polarity is configured to prevent breakage of a meniscus in the drop generator after a drop is emitted.

6. The drop emitting device of claim 1 wherein the delay is in the range of about 2 microseconds to about 7 microseconds.

7. The drop emitting device of claim 1 wherein the drop generator is operated at a drop firing frequency of at least about 10 KHz.

8. The drop emitting device of claim 1 wherein the drop generator is operated at a drop firing frequency in the range of about 10 KHz to about 40 KHz.

9. The drop emitting device of claim 1 wherein the first pulse of the second polarity has a duration that is less than a duration of the pulse of the first polarity.

10. The drop emitting device of claim 1 wherein the second pulse of the second polarity has a duration that is less than a duration of the pulse of the first polarity.

11. The drop emitting device of claim 1 wherein the second pulse of the second polarity has a duration that is less than a duration of the first pulse of the second polarity.

12. The drop emitting device of claim 1 wherein the second pulse of the second polarity has a generally triangular shape.

13. The drop emitting device of claim 1 wherein the second pulse of the second polarity has a generally trapezoidal shape.

14. The drop emitting device of claim 1 wherein the pulse of the first polarity has a magnitude in the range of about 33 volts to about 47 volts.

15. The drop emitting device of claim 1 wherein the pulse of the first polarity has a magnitude of no more than about 39 volts.

16. The drop emitting device of claim 1 wherein the first pulse of the second polarity has a peak magnitude in the range of about 30 volts to about 47 volts.

17. The drop emitting device of claim 1 wherein the first pulse of the second polarity has a peak magnitude no more than about 35 volts.

18. The drop emitting device of claim 1 wherein the second pulse of the second polarity has a peak magnitude in the range of about 15 volts to about 47 volts.

19. The drop emitting device of claim 1 wherein the second pulse of the second polarity has a peak amplitude that is no more than about 22 volts.

20. The drop emitting device of claim 1 wherein the second pulse of the second polarity has a peak amplitude that is less than a peak amplitude of the first pulse of the second polarity.

21. A drop emitting device comprising:

a piezoelectric drop generator;

a drop firing waveform applied to the piezoelectric drop generator during a drop firing interval; and the drop firing waveform including in sequence a pulse of a first polarity having a peak magnitude in the range of about 33 volts to about 47 volts, a first pulse of a second polarity having a peak magnitude in the range of about 30 volts to about 47 volts, a delay interval, and a second pulse of the second polarity having a peak magnitude in the range of about 15 volts to about 47 volts, wherein the second polarity is different from the first polarity.

22. The drop emitting device of claim 21 wherein the drop generator comprises a piezo transducer.

23. The drop emitting device of claim 21 wherein the pulse of the first polarity and the first pulse of the second polarity are configured to cause a drop to be emitted.

24. The drop emitting device of claim 21 wherein:

the pulse of the first polarity and the first pulse of the second polarity are configured to cause a drop to be emitted; and the second pulse of the second polarity is configured to dissipate residual energy remaining in the drop generator after a drop is emitted.

25. The drop emitting device of claim 21 wherein:

the pulse of the first polarity and the first pulse of the second polarity are configured to cause a drop to be emitted; and the second pulse of the second polarity is configured to prevent breakage of a meniscus in the drop generator after a drop is emitted.

26. The drop emitting device of claim 21 wherein the delay is in the range of about 2 microseconds to about 7 microseconds.

27. The drop emitting device of claim 21 wherein the first pulse of the second polarity has a duration that is less than a duration of the pulse of the first polarity.

28. The drop emitting device of claim 21 wherein the second pulse of the second polarity has a duration that is less than a duration of the pulse of the first polarity.

29. The drop emitting device of claim 21 wherein the second pulse of the second polarity has a duration that is less than a duration of the first pulse of the second polarity.

30. The drop emitting device of claim 21 wherein the second pulse of the second polarity has a generally triangular shape.

31. The drop emitting device of claim 21 wherein the second pulse of the second polarity has a generally trapezoidal shape.

32. The drop emitting device of claim 21 wherein the pulse of the first polarity has a magnitude of no more than about 39 volts.

33. The drop emitting device of claim 21 wherein the first pulse of the second polarity has a peak magnitude no more than about 35 volts.

34. The drop emitting device of claim 21 wherein the second pulse of the second polarity has a peak amplitude that is no more than about 22 volts.

35. The drop emitting device of claim 21 wherein the second pulse of the second polarity has a peak amplitude that is less than a peak amplitude of the first pulse of the second polarity.

36. A drop emitting device comprising:

a piezoelectric drop generator;

a drop firing waveform applied to the piezoelectric drop generator during a drop firing interval; and the drop firing waveform including in sequence a pulse of a first polarity having a duration in the range of about 10 microseconds to about 16 microseconds, a first pulse of second polarity having a duration in the range of about 3 microseconds to about 7 microseconds, a delay interval in the range of about 2 to about 7 microseconds, and a second pulse of the second polarity having a duration in the range of about 2 microseconds to about 8 microseconds, wherein the second polarity is different from the first polarity.

37. The drop emitting device of claim 36 wherein the drop generator comprises a piezo transducer.

38. The drop emitting device of claim 36 wherein the pulse of the first polarity and the first pulse of the second polarity are configured to cause a drop to be emitted.

39. The drop emitting device of claim 36 wherein:

the pulse of the first polarity and the first pulse of the second polarity are configured to cause a drop to be emitted; and the second pulse of the second polarity is configured to dissipate residual energy remaining in the drop generator after a drop is emitted.

40. The drop emitting device of claim 36 wherein:

the pulse of the first polarity and the first pulse of the second polarity are configured to cause a drop to be emitted; and the second pulse of the second polarity is configured to prevent breakage of a meniscus in the drop generator after a drop is emitted.

41. The drop emitting device of claim 36 wherein the second pulse of the second polarity has a duration that is less than a duration of the first pulse of the second polarity.

42. The drop emitting device of claim 36 wherein the second pulse of the second polarity has a generally triangular shape.

43. The drop emitting device of claim 36 wherein the second pulse of the second polarity has a generally trapezoidal shape.

44. The drop emitting device of claim 36 wherein the pulse of the first polarity has a magnitude in the range of about 33 volts to about 47 volts.

45. The drop emitting device of claim 36 wherein the pulse of the first polarity has a magnitude of no more than about 39 volts.

46. The drop emitting device of claim 36 wherein the first pulse of the second polarity has a peak magnitude in the range of about 30 volts to about 47 volts.

47. The drop emitting device of claim 36 wherein the first pulse of the second polarity has a peak magnitude no more than about 35 volts.

48. The drop emitting device of claim 36 wherein the second pulse of the second polarity has a peak magnitude in the range of about 15 volts to about 47 volts.

49. The drop emitting device of claim 38 wherein the second pulse of the second polarity has a peak amplitude that is no more than about 22 volts.

50. The drop emitting device of claim 36 wherein the second pulse of the second polarity has a peak amplitude that is less than a peak amplitude of the first pulse of the second polarity.

* * * * *